US011143485B2

(12) United States Patent
Garthaffner et al.

(10) Patent No.: US 11,143,485 B2
(45) Date of Patent: Oct. 12, 2021

(54) LOADING DEVICE AND METHOD

(71) Applicants: Martin T. Garthaffner, Chesterfield, VA (US); Aaron M. Garthaffner, Doswell, VA (US)

(72) Inventors: Martin T. Garthaffner, Chesterfield, VA (US); Aaron M. Garthaffner, Doswell, VA (US)

( * ) Notice: Subject to any disclaimer, the term of this patent is extended or adjusted under 35 U.S.C. 154(b) by 359 days.

(21) Appl. No.: 16/057,264

(22) Filed: Aug. 7, 2018

(65) Prior Publication Data

US 2019/0041159 A1 Feb. 7, 2019

Related U.S. Application Data

(60) Provisional application No. 62/542,110, filed on Aug. 7, 2017.

(51) Int. Cl.
*F41C 9/08* (2006.01)

(52) U.S. Cl.
CPC ..... *F41C 9/085* (2013.01)

(58) Field of Classification Search
CPC ..... F41C 9/085; F41C 9/08
USPC ..... 42/90
See application file for complete search history.

(56) References Cited

U.S. PATENT DOCUMENTS 4,050,175 A 9/1977 Mulinix
4,112,606 A * 9/1978 Griffin ..... F41C 9/085 42/90
4,135,322 A * 1/1979 Tice ..... F41C 9/085 42/90
4,373,285 A 2/1983 Grout et al.
4,466,209 A * 8/1984 Strickland ..... F41C 9/085 42/90
4,536,983 A * 8/1985 Fry ..... F41C 9/085 42/90
4,550,517 A * 11/1985 Mansfield ..... F41C 9/085 42/90
4,589,220 A * 5/1986 Lofland ..... F41C 9/085 42/90
4,601,125 A 7/1986 Curtis
4,607,446 A * 8/1986 Scheuring ..... F41C 9/085 42/90
4,862,623 A * 9/1989 Delap ..... F41C 9/085 42/90

(Continued)

*Primary Examiner* — Michelle Clement
(74) *Attorney, Agent, or Firm* — Ditthavong, Steiner & Mlotkowski

(57) ABSTRACT

A load carrier for a muzzleloader having a muzzle, comprising a first assembly component and a second assembly component, the first assembly component comprising a tubular open-ended charge receiving body configured to receive a charge though an open end section of the charge receiving body with the second assembly component comprising a tubular delivery body comprising a delivery end section and a connector end section, the delivery end section having an external diameter so as to be insertable into the muzzle and a removeable cap engageable with the delivery end section. The connector end section of the second assembly component may be engageable with the open end section of the charge receiving body of the first assembly component. Insertion of at least a portion of the delivery end section into the muzzle during pouring facilitates consistent and speedy loading. The disclosure also provides associated methods.

20 Claims, 4 Drawing Sheets

(56) References Cited

U.S. PATENT DOCUMENTS

| | | | | | |
|---|---|---|---|---|---|
| 4,974,357 | A * | 12/1990 | Jones | ..... | F41C 9/085<br>42/90 |
| 5,109,623 | A * | 5/1992 | French | ..... | F41C 9/085<br>42/90 |
| 6,637,143 | B1 * | 10/2003 | Wykle | ..... | F41C 9/085<br>224/150 |
| 7,165,351 | B2 | 1/2007 | Church | | |
| 8,112,932 | B1 * | 2/2012 | Vollmer | ..... | F41C 9/085<br>42/90 |
| 9,752,847 | B2 * | 9/2017 | Steele | ..... | F41C 9/085 |

* cited by examiner

FIG. 8A
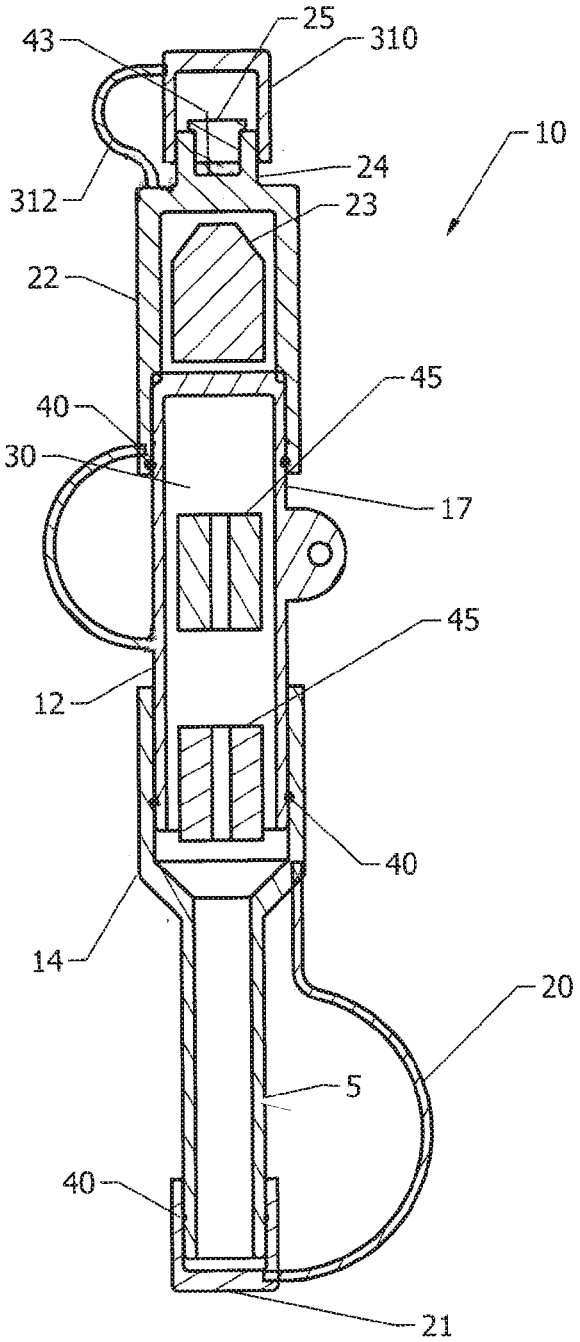
FIG. 8B
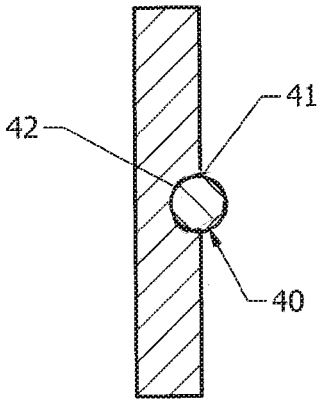
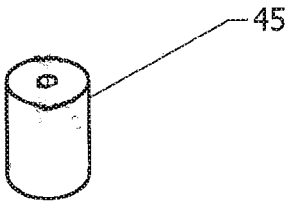
FIG. 8C

LOADING DEVICE AND METHOD

RELATED APPLICATION

This application claims priority to U.S. Provisional Application No. 62/542,110, filed on Aug. 7, 2017, the contents of which are hereby incorporated in their entirety.

FIELD

The present disclosure relates generally to apparatus for facilitating loading of a muzzle-loading firearm, and more particularly to apparatus for facilitating loading of a muzzle-loading firearm, which includes facility for storing a complete load until use.

Environment

The loading of a muzzle-loading firearm is a slow and cumbersome process that may involve holding the firearm with one hand, and with the other, single-handedly manipulating several separate load components, such a charge of gunpowder, a projectile, a patch or Sabot, and a percussion (primer) cap. It may also involve single-handed manipulation of various discrete accessories such as short starters and measurers. Excitement of a hunting situation may exacerbate difficulties in the proper handling of the gun, together with the aforementioned load components and accessories. Reloading while hunting from a tree stand is particularly difficult with previously known techniques and accessories.

Prior load carrying devices have been proposed which carry load components for a firearm which are intended to aid in the loading process itself. One particular loading device includes a chamber body which has a chamber open at both ends. A projectile is placed in a lower portion of the chamber. Once placed, it functions as a closure member (plug) for that end of the chamber so that gun powder may be held in the upper portion of the chamber. The upper chamber portion is closable with a closure member. Examples include the Magnum Speed Loader from Black-Powder Products Inc. (Mfg. No. AC1617A); the CVA Magnum Pellet Speed Loader from Connecticut Valley Arms and loaders described in U.S. Pat. No. 4,135,322 to Trice et al., and U.S. Pat. No. 4,373,285 to Grout et al.

A muzzle-loading firearm is loaded with the aid of the aforementioned loading device by opening the upper chamber portion and pouring the powder charge from the upper chamber portion into the muzzle of the firearm. The pouring must be done carefully, because any spilling will affect (degrade) accuracy of the next shot. Unfortunately, because the chamber is sized to receive the projectile, the upper chamber portion is oversized for pouring purposes. After pouring the gun powder, the lower section of the body is then placed against the muzzle of the rifle barrel and a projectile is pushed from the chamber into the barrel of the rifle with a ram rod. In other words, the loading device and the end of the rifle must both be held in proper alignment with one hand while the ramrod is manipulated with the other hand. This is an extremely difficult procedure with the use of a conventional ramrod. Furthermore, the inner diameter of the chamber must match the caliber of the muzzle, such that the chamber body must be positioned outside the muzzle during pouring of the gun powder and use of the ramrod.

A conventional "short starter" represents another piece of equipment (accessory, accoutrement). In most cases, a short starter is used to push a projectile placed at the barrel muzzle a short distance down the barrel so as to make it easier to engage the elongated ramrod for the final seating of the projectile against the change of powder. Use of the aforementioned load carrying device frustrates effective use of conventional short starters, because the short starters must be extended through the entire length of the chamber of the load carrying device before reaching the muzzle. In order to give the short starter full effect, the loader has to be removed from the muzzle and the short starter used a second time, which adds another step to an already involved process.

Accordingly, prior loading devices may contribute to inaccurate shooting by failing to facilitate pouring of the gunpowder in a manner that avoids spilling and/or they frustrate the benefits of short starters and/or they contribute vexatious manipulation of multiple pieces and accessories during loading.

These and other difficulties experienced with the prior art loading devices for muzzle-loading have been overcome by the load carrier of the present disclosure.

It is therefore, a principle object of this disclosure to provide a loading device for a muzzle loader that is convenient to carry and which may protectively contain load components, including a premeasured charge of gun powder, a projectile and/or a primer.

Another object of this disclosure is the provision of a loading device for a muzzle-loading firearm which has a capacity to contain all of the load components and to provide tooling (devices) that may be used to facilitate certain operations in the loading process of a muzzle-loading firearm.

Still another object of the present disclosure is to provide a load carrier device which a capacity to pour gun powder into the muzzle in a manner which minimizes/eliminates spillage of the powder charge during the loading process.

Another object of this disclosure is to provide a loading device with an arrangement for attaching a ring or lanyard so that the device may be retained when released from grip, so as to free up both hands during muzzle loading operations and to assure retention of the loading device even while in a tree stand or the like.

Another object of this disclosure is to provide a load container device which includes an integrated short starter such that the benefits of using a short starter may be fully realized without vexation of having to manipulate a separate piece or accessory for short starting.

Yet another object of this disclosure is to improve the speed of loading a muzzle-loading firearm and the accuracy of the muzzle-loading rifle by avoiding any spillage of the gunpowder charge during the placement of the charge into the muzzle end of the rifle barrel.

A further object of the present disclosure is the provision of a loading device for a muzzle-loading firearm that is simple in construction, convenient to carry in the field and easy to use.

SUMMARY

An aspect of the present disclosure provides a method of loading a muzzleloader with a charge, comprising protectively containing a premeasured charge until use by uncoupling a first tubular body from a second tubular body and placing a charge into the first tubular body, coupling the first and second tubular bodies, and closing a delivery end of the second tubular body, whereby the charge is contained within the first and second tubular bodies until use. The method further comprises delivering a premeasured charge into a muzzleloader by opening the delivery end of the second tubular body, tilting the coupled first and second tubular bodies from an upright position toward a downwardly inclined position while inserting the delivery end at least partially into a muzzle of the muzzleloader In some embodiments, the method may further comprise short starting a projectile into the muzzle with the delivery end of the second body.

Another aspect of the present disclosure provides a system for containing and loading a charge into a muzzleloader, comprising a first tubular receiving body having a closed end, an open end and a space enclosed by the first tubular body of sufficient volume to fully receive a charge, a second tubular delivery body comprising an open ended connector section connectable with the open end of the first tubular receiving body, a delivery section comprising a tubular neck receivable within a bore of a muzzleloader, the inner diameter of the tubular neck being less than an inner diameter of the open ended connector section, a frustoconical transition section communicating the open ended connector section with the delivery section, a removable closure operable to close a delivery end of the delivery section, wherein the first tubular receiving body and the second tubular delivery body may be uncoupled to place a premeasured charge in the first tubular receiving body, whereupon the first tubular receiving body and the second tubular delivery body may be coupled and the removable closure closed to protectively retain the premeasured charge until use, whereupon the closure may be opened and the delivery section may facilitate pouring of the charge while tilting the system and at least partially inserting the delivery end of the tubular neck into the bore of the muzzleloader.

In some embodiments the frustoconical transition section may converge at an angle in the range of about 43 to about 47 degrees and an inner diameter of the tubular neck is sufficiently greater than a largest nominal dimension of granules comprising the charge, whereby bridging of granules across the tubular neck is alleviated.

Yet another aspect of the present disclosure provides a load carrier for a muzzleloader having a muzzle, comprising a first assembly component comprising a tubular open-ended charge receiving body configured to receive a charge though an open end section of the charge receiving body and a second assembly component engageable with the first assembly component, comprising a tubular delivery body comprising a delivery end section and a connector end section, the delivery end section having an external diameter so as to be insertable into the muzzle and a removeable cap engageable with the delivery end section, with the connector end section being engageable with the open end section of the charge receiving body of the first assembly component, whereby when the second assembly component is disengaged from the first assembly component a charge of gunpowder may be directly received by the charge receiving body of the first assembly component, whereby the received charge may be contained until use by engagement of the first assembly component with the second assembly component and by engagement of the cap, whereby the contained charge may be poured into the muzzle by disengaging the cap while maintaining engagement of the second assembly component with the first assembly component, and whereby insertion of at least a portion of the delivery end section into the muzzle during pouring facilitates consistent and speedy loading.

In some embodiments, the first assembly component may further comprise a tubular projectile receiving body configured to receive a projectile though an open end section of the projectile receiving body, with the open-end section of the projectile receiving body being engageable with a closed end section of the charge receiving body, whereby the projectile receiving body is closable with such engagement and openable with disengagement of the open end section of the projectile receiving body from the closed end section of the charge receiving body, and whereby a projectile may be contained within the first assembly component until use.

In some embodiments, the first assembly component may further comprise a flexible connector between the projectile receiving body and the charge receiving body and the second assembly component may further comprise a flexible connector between the cap and the tubular delivery body. In further embodiments, at least one of the first body and/or the second body may be a unitary, molded piece. In addition, the projectile receiving body of the first assembly component may further comprise a nipple to receive a primer, and the nipple may include a slot to facilitate removal of a primer from the nipple. The nipple may be provided with a depth such that a fully received primer extends beyond the nipple, whereby removal of a primer from the nipple is facilitated. In some embodiments, the nipple may be of a size sufficient to fully receive any one of a variety of primers of differing standard sizes.

In further embodiments, the connector end section of the tubular delivery body may engage about an outer surface of the open end section of the charge receiving body.

In some embodiments, the connector end section may have an inner diameter greater than an inner diameter of the delivery end section, and the tubular delivery body may further comprising a frustoconical transition section between the delivery end section and the connector end section. In some embodiments, the frustoconical transition section may converge at an angle $\alpha$ in the range of about 40 to about 50 degrees or may converge at an angle $\alpha$ in the range of about 43 to about 47 degrees, or at an angle $\alpha$ of about 45 degrees.

In some embodiments, the delivery end section may have an inner diameter greater than about three times a largest nominal dimension of granules comprising the charge, whereby bridging of the granules along the delivery end section is avoided. In various embodiments, the delivery end section may have a length sufficient for placement of a finger and a thumb of a same hand such that the cap may be removed from the tubular delivery body single-handedly, and/or may have a length sufficient to abate spilling of a portion of the charge while moving of the load carrier from an upright position into a tilted, pouring position and/or may have a length sufficient to by-pass a muzzle brake adjacent the muzzle and/or may have a length and configuration to be operative as a short starter.

In some embodiments, the load carrier may further comprise a seal operative between at least one of the cap and the delivery end section of the tubular delivery body, the open end section of the charge receiving body and the connector end section of the tubular delivery body, and the closed end section of the charge receiving body and the open end section of the projectile receiving body.

In some embodiments, the seal may comprise a resilient ring retained in a circumferential groove and/or the outer diameter of the delivery end section of the tubular delivery body may be less than the caliber of the muzzle and/or an outer diameter of the connector end section of the tubular delivery body maybe greater than the caliber of the muzzle, whereby the transition section is operative as a stop against further insertion of the tubular delivery body into the muzzle.

In further embodiments, the cap may be cup shaped and/or may engage the delivery end section of the tubular delivery body with a first sliding fit, and/or the connector end section about the outer surface of the open end section of charge receiving body with a second sliding fit, wherein the second sliding fit may be more resistive to opening than the first sliding fit, whereby the cap may be removed without disengaging the second assembly component from the first assembly component.

In additional embodiments, the load carrier may further comprise a lanyard and a receiver for attachment of the lanyard to the load carrier. In some embodiments, the first assembly component may further comprise a tab and the tab may include an aperture for receiving a lanyard and/or the tab may extend from an intermediate location along the charge receiving body.

In some embodiments, the loading device may further comprise a second cap removably engageable with the nipple, which when engaged with the nipple, the second cap may be operative to protect content of the nipple from a surrounding environment and may further comprise a flexible connector operative between the second cap and the projectile receiving body, and wherein the nipple may be of a sufficient size to receive any one of a variety of differing standard sized primers.

In some embodiments, the tubular delivery body and the charge receiving body contain the charge until use an/or the tubular delivery body may be articulated such that the delivery end section and the frustoconical transition section may be disengageable as a unit from the connector end section of the tubular delivery body. The load carrier may further comprise a flexible connector between the unit and the connector end section of the tubular delivery body.

Still another aspect of the present disclosure provides tubular delivery body operable with an open ended, tubular load carrier for a muzzleloader.

BRIEF DESCRIPTION OF THE DRAWINGS

The forms disclosed herein are illustrated by way of example, and not by way of limitation, in the figures of the accompanying drawings and in which like reference numerals refer to similar elements and in which:

FIG. 8A is a cross-sectional view of the loading device shown in FIG. 1 containing a shaped pellet form of gunpowder therein, together with a plurality of seals;

FIG. 8B is a cross-sectional detail view of one of the seals shown also in FIGS. 8A and 9;

FIG. 8C is a perspective view of a shaped pellet of gunpowder that is also shown in cross-section in FIG. 8A;

DETAILED DESCRIPTION

Figure 1:
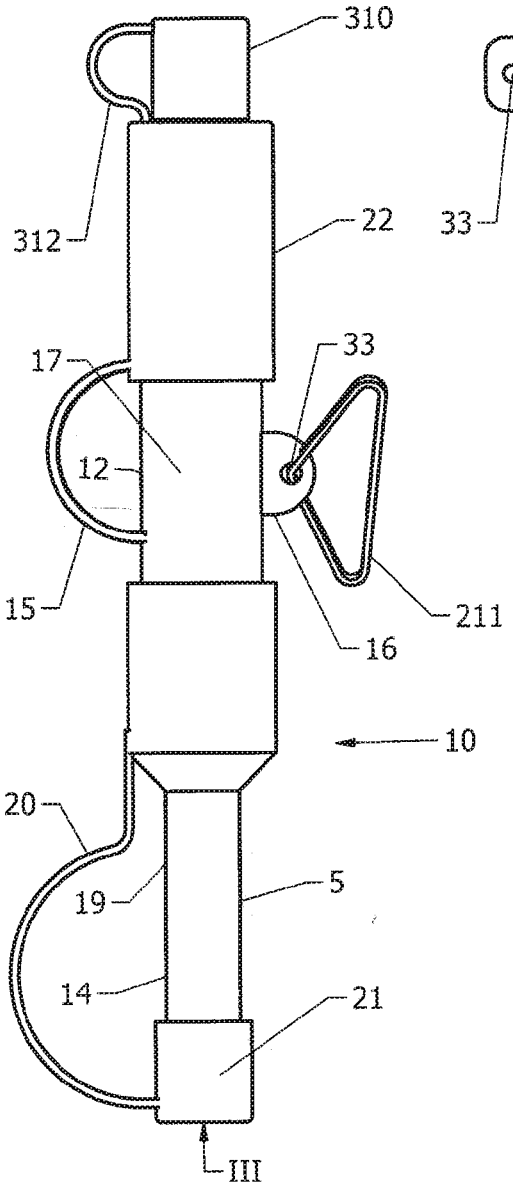
FIG. 1 is a side planar side view of a loading device in a loaded and assembled condition, constructed in accordance with an embodiment the present disclosure.

Each of the following terms written in singular grammatical form: "a," "an," and "the," as used herein, may also refer to, and encompass, a plurality of the stated entity or object, unless otherwise specifically defined or stated herein, or, unless the context clearly dictates otherwise. For example, the phrases "a device," "an assembly," "a mechanism," "a component," and "an element," as used herein, may also refer to, and encompass, a plurality of devices, a plurality of assemblies, a plurality of mechanisms, a plurality of components, and a plurality of elements, respectively.

Each of the following terms: "includes," "including," "has," "having," "comprises," and "comprising," and, their linguistic or grammatical variants, derivatives, and/or conjugates, as used herein, means "including, but not limited to."

Throughout the illustrative description, the examples, and the appended claims, a numerical value of a parameter, feature, object, or dimension, may be stated or described in terms of a numerical range format. It is to be fully understood that the stated numerical range format is provided for illustrating implementation of the forms disclosed herein, and is not to be understood or construed as inflexibly limiting the scope of the forms disclosed herein.

Moreover, for stating or describing a numerical range, the phrase "in a range of between about a first numerical value and about a second numerical value," is considered equivalent to, and means the same as, the phrase "in a range of from about a first numerical value to about a second numerical value," and, thus, the two equivalently meaning phrases may be used interchangeably.

It is to be understood that the various forms disclosed herein are not limited in their application to the details of the order or sequence, and number, of steps or procedures, and sub-steps or sub-procedures, of operation or implementation of forms of the method or to the details of type, composition, construction, arrangement, order and number of the system, system sub-units, devices, assemblies, sub-assemblies, mechanisms, structures, components, elements, and configurations, and, peripheral equipment, utilities, accessories, and materials of forms of the system, set forth in the following illustrative description, accompanying drawings, and examples, unless otherwise specifically stated herein. The apparatus, systems and methods disclosed herein can be practiced or implemented according to various other alternative forms and in various other alternative ways.

It is also to be understood that all technical and scientific words, terms, and/or phrases, used herein throughout the present disclosure have either the identical or similar meaning as commonly understood by one of ordinary skill in the art, unless otherwise specifically defined or stated herein. Phraseology, terminology, and, notation, employed herein throughout the present disclosure are for the purpose of description and should not be regarded as limiting.

Figure 2:
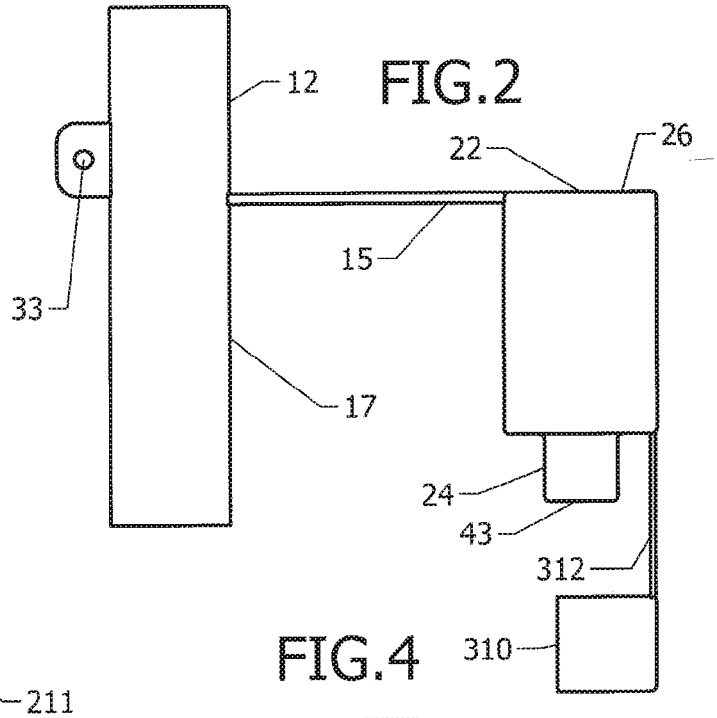
FIG. 2 is a planar side view of a first assembly component of the loading device of FIG. 1, in an unloaded, unassembled condition.
Figure 4:
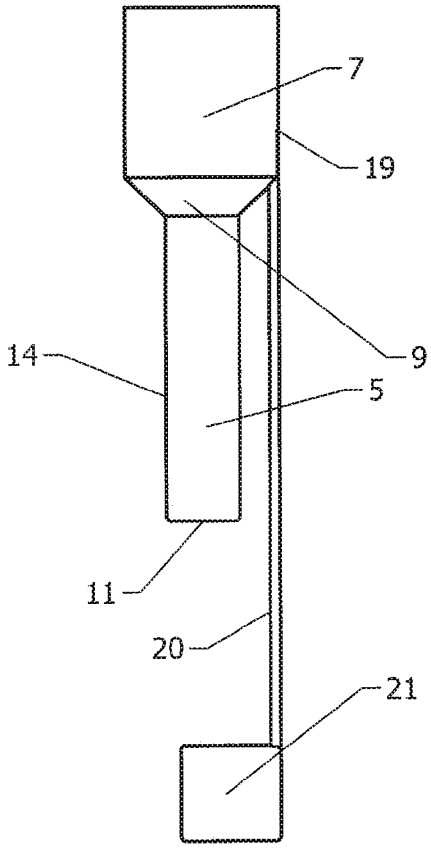
FIG. 4 is a planar side view of a second assembly component of the loading device of FIG. 1, in an unloaded, unassembled condition.
Figure 3:
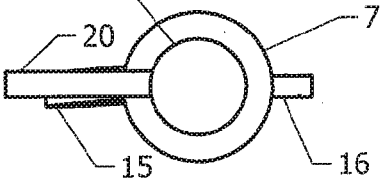
FIG. 3 is a planar end view of the loading device of FIG. 1 in the direction of arrow III in FIG. 1.
Figure 5:
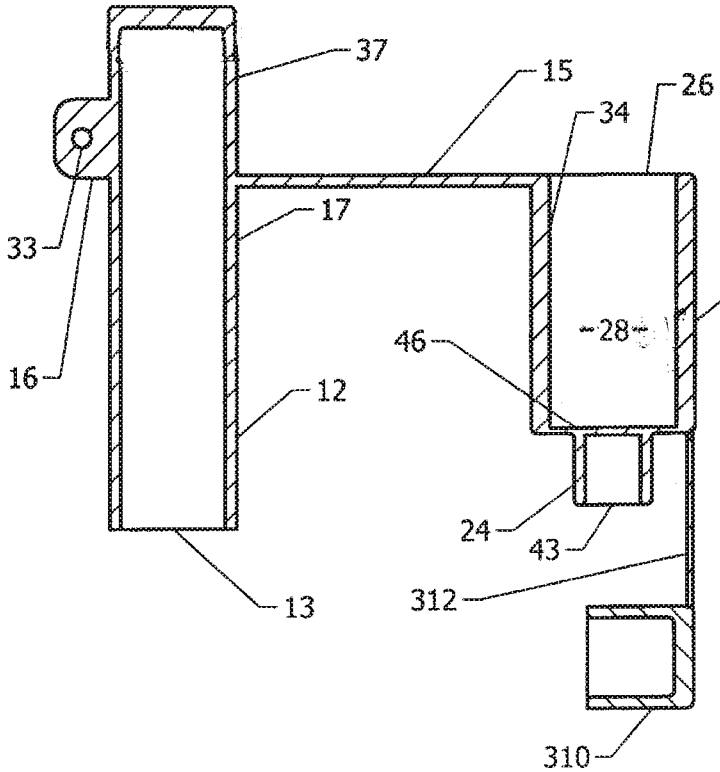
FIG. 5 is a cross-sectional view of the first assembly component shown in FIG. 2.

Referring to FIGS. 1, 2 and 5, an embodiment of the present disclosure provides a loading device 10 which may comprise a first assembly component 17 and a second assembly component 19. The first assembly component 17 may comprise a tubular charge receiving body 12 (or chamber) that is configured to receive a (premeasured) charge of gunpowder in its chamber through an open end 13 of the charge receiving body 12 (see FIG. 5). In some embodiments, the first assembly component 17 may further comprise a tubular, open-ended, projectile receiving, body 22 (or chamber), that is configured to receive a projectile or projectiles (including shot) in its chamber 28 through an open end 26 of the projectile chamber body 22 (again, see FIG. 5). The projectile receiving body 22 may be connected with the charge receiving body 12 by a flexible (resilient) web 15. The web 15 as well as the entire loading device 10 may be made of a thermoplastic material such as polypropylene or a flexible synthetic, especially one that is conducive to injection molding.

The gunpowder may comprise a black powder, a black powder substitute, smokeless powder or other propellent, explosive or agent. The gunpowder may be in a granular form or in the form of shaped pellets that may be configured to have a diameter less than and/or approximate of the bore of muzzleloader.

In some embodiments, the projectile receiving body 22 may include an annular protrusion (nipple) 24 which may be provided with a cavity 43 of sufficient size for facile insertion and removal of a primer cap (igniter) 25. In some embodiments, cavity 43 may be sized to receive any one of a plurality of standard sized (commercially available) primers (primer caps) 25, such as by way of non-limiting example, primers commercially designated as #10, #11 or #209. The loading device 10 may further comprise a closure cap 310, which may be configured to be slidingly received about the nipple 24 so as to seal the cavity 43 and protect the contents thereof (i.e., a stowed primer 25) from the surrounding environment. By such arrangement, the primer 25 may be kept dry while in a stowed condition within the nipple 24.

In some embodiments, the closure cap 310 may be connected to another component of the loading device 10, such as the projectile receiving body 22 with a connector web 312, which facilitates retention of the closure cap 310 after use of the loading device 10. In some embodiments, the closure cap 310 and the closure cap 21 may be of a common size.

Optionally, the nipple 24 may be provided with a longitudinal slot which may make the nipple 24 more flexible so as to better hold and release the primer cap 25 when it is needed during the muzzle loading process. The width of the slot may be sized to receive an end portion of a small hand tool such as a key or pick, which may be used to pry against an edge of the primer cap 25 to further facilitate its release.

Referring now to FIG. 5, in an embodiment, the chamber 28 of the projectile receiving body 22 may be provided with a flat bottom 46 and a bore 34 which may be of a size (diameter) such that a snug (slideable interference) fit may be established between the bore portion 34 adjacent the open end 26 of the projectile chamber body 22 and the closed end portion 37 of the tubular charge receiving body 12, when pressed together, When pressed together, the closed end portion 37 of the tubular charge receiving body 12 and the projectile chamber body 22 establish a chamber 28 for protectively containing the projectile 23.

Figure 7:
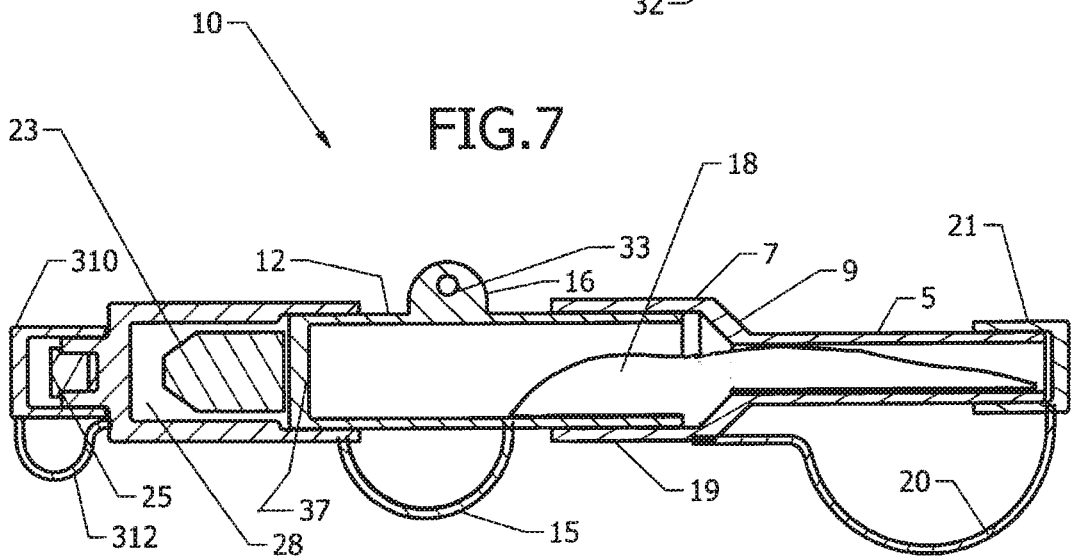
FIG. 7 is a cross-sectional view of the loading device shown in FIG. 1.

Referring now to FIG. 7, in some embodiments, the bore 34 may be a stepped inner bore comprising a first narrower bore portion adjacent the flat bottom 46 that has a diameter slightly greater than the diameter of the projectile 23 (and the caliber of the firearm) such that the projectile 23 may be slidingly received and slidingly removed from the projectile receiving body 22. A minimum clearance of approximately 0.025 inch may suffice. The stepped inner bore may further comprise a second wider bore portion 34 adjacent the free (open) end 26 of the projectile receiving body 22 which is sized to receive the closed end portion 37 of the charge receiving body 12. The transition between the narrower and wider bore portions may serve as a stop as the closed end portion 37 of the tubular charge receiving body 12 and the projectile chamber body 22 are pressed together.

In some embodiments, the charge receiving body 12 may also be provided with a semi-circular raised protrusion (tab) 16 at an intermediate location along the length of the charge receiving body 12 in which a hole (aperture) 33 is provided for attachment of a lanyard (or ring) 211. The lanyard 211 may be sized to allow a shooter to place a (middle) finger or several fingers through the lanyard 211 so that the device may be retained against the palm of the same hand, freeing up both hands for executing a faster and more accurate loading in the field. The lanyard 211 may also be provided with a longer length together with a slideable clasp (slider or cord shortener) such that the lanyard 211 may be looped about the shooter's neck and then shortened using the slider when the shooter desires to use the lanyard as previously described. The lanyard 211 also assures that the loading device 10 together with the load contained therein is not lost should grip upon the loading device 10 be the accidentally released at any time during the loading process. This aspect is especially helpful to hunters who are reloading while perched in a tree stand. It is contemplated that the tab 16 may be positioned on another component of the loading device 10, such as the projectile receiving body 22 and/or the tubular delivery body 14 or other component. It is to be realized that the tab 16 serves as a receiver for the lanyard 211 and could be shaped and/or constructed differently from what is specifically shown and described herein.

Figure 6:
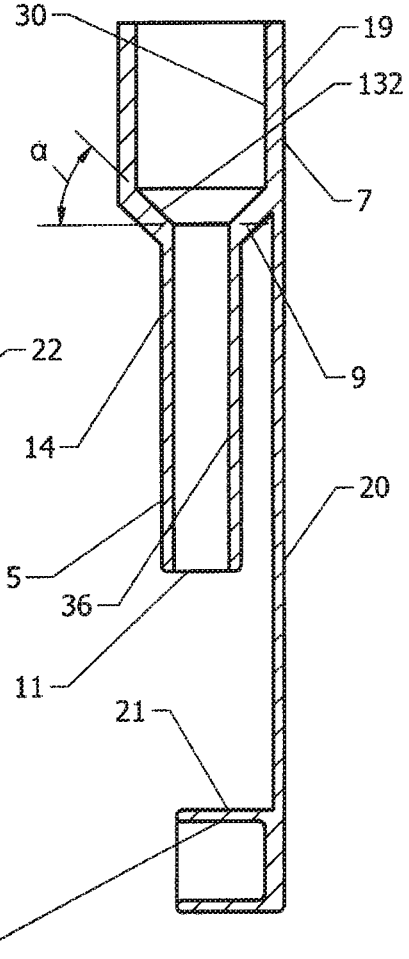
FIG. 6 is a cross-sectional view of the second assembly component shown in FIG. 4.

Referring now to FIGS. 1, 6 and 7, in some embodiments, the second assembly component 19 may comprise a tubular delivery body 14 and a closure 21. The tubular delivery body 14 may comprise a delivery end section (tubular neck) 5, a connector section 7 and a transition section 9 which communicates the delivery end section (tubular neck) 5 with the connector end section 7.

Still referring now to FIGS. 1, 6 and 7, the closure 21 of the second body assembly 19 may comprise a cap for selectively closing and opening the free (open) end 11 of the delivery end section 5. In the exemplary embodiment, the cap 21 is constructed from a resilient material and is sized to slideably engage over the free end 11 of the delivery end section 5. In some embodiments, the cap 21 may be attached to the tubular delivery body 14 by a flexible resilient connector web 20. In some embodiments, the web 20, while in an un-flexed state, may extend from the connector section 7 and/or the transition section 9 of the tubular delivery body 14 to the cap 21 in a direction parallel to the longitudinal axis of the tubular delivery body 14. Such arrangement provides the second assembly component 19 with a rather compact form when not in use.

Referring now to FIG. 6, the connector section 7 of the tubular delivery body 14 may be provided with a cylindrical receiving portion 30 having an internal diameter such that it may be slidingly received at the open end 13 of the charge receiving body 12 with a sliding interference fit; whereas the delivery section 5 is provided with and outside diameter slightly less than the caliber of the muzzle-loading firearm such that it may be freely (slidingly) inserted into and removed from the bore of firearm. The delivery section 5 may be provided with an outside diameter of 0.440 inch for muzzleloaders of .45 caliber or greater, which arrangement provides sufficient clearance for air to escape as gunpowder is poured into the muzzle through the delivery section 5.

Referring now to FIGS. 1 and 2, for purposes of loading the loading device 10 with a charge of gunpowder, the second assembly component 19 is removed from engagement with the first assembly component 17, and the first assembly component 17 is rotated into an orientation such that the open end 13 is directed upwardly (in a direction opposite of how it is shown in FIG. 2). A premeasured charge of gunpowder may then be poured into the charge receiving body 12, with or without the assistance of a funnel. If desired, the tubular delivery body 14 may serve as a funnel by inserting at least a portion of the delivery end section 5 of the delivery body 14 into the open end 13 of the charge receiving body 12.

Once a premeasured charge of gunpowder has been placed in the charge receiving body 12, the second assembly component 19 is reengaged with the open end 13 of the charge receiving body 12 via the sliding interference fit between the connector end section 7 and the open end 13 of the charge receiving body 12. At this time, the cap 21 may be secured upon the delivery end 11 of the delivery section 5 of the tubular delivery body 14. Thereupon, communication is established between the volumes enclosed by both the charge receiving body 12 and the tubular delivery body 14 (including the delivery section 5 and the transition section 9 of the latter). The premeasured charge is isolated from the environment by the aforementioned closure of the cap 21 and the joinder of the tubular delivery body 14 upon the open end 13 of the charge receiving body 12. The premeasured charge is ready to be poured upon removal of the cap 21 from opening the delivery end 11 of the tubular delivery body 14. Until such time, the premeasured charge is protectively contained.

It is noted that the placement of the primer 25 in the nipple 24, the placement of the projectile 23 in the projectile chamber body 22, and placement of a charge of gunpowder in the charge receiving body 12 may be undertaken in any order, however it may prove expedient to load the projectile first and reconnect the projectile receiving body 22 with the closed end 37 of the charge receiving body 12.

It is also noted that the projectile receiving body 22 is interposed between the contained powder charge and the primer 25 that is held by nipple 24, which arrangement minimizes the possibility of an accidental discharge of the primer 25 igniting the contained charge of gunpowder 18.

Referring now to FIG. 7, when readied for use, all elements of a load may be in a stowed condition within the loading device 10 in a manner conducive to retention in coat pockets and the like of the user. More particularly, the primer 25 is retained in the nipple 24 and the cap 310, and the projectile 23 within the projectile chamber body 22. A charge of gunpowder 18 is stowed within the confines defined by the charge receiving body 12, the tubular delivery body 14 and the cap 21. In anticipation of use the loading device 10 is oriented vertically such that the cap 21 may be positioned atop the loading device 10 (such as in the orientation shown in FIG. 1).

Upon removal of the cap 21, the loading device 10 is then tilted toward the muzzle of a muzzleloader until the delivery end 11 of the delivery body 14 is inserted into the muzzle to allow a facile, speedy and complete transfer of the gunpowder 18 from the loading device 10 to the muzzle of the firearm. Because the delivery section 5 of the delivery body 14 may be inserted into the muzzle itself, spilling is avoided and complete delivery of the entire stowed charge of gunpowder is assured. Such arrangement provides a capacity for speedy and consistent loadings of a muzzleloader from one loading to the next, which may enhance accurate placement of shots (grouping) when target shooting.

In some embodiments, the delivery section 5 of the delivery body 14 may have a length sufficient to delay flow of the gunpowder 18 through the delivery end 11 to allow the user an opportunity to at least align if not wholly insert the delivery end 11 into the muzzle of the firearm before gunpowder begins to flow out of the loading device 10. In other embodiments, the delivery section 5 of the tubular delivery body 14 may have a length sufficient to bypass muzzle brakes and other openings in the barrel adjacent the muzzle. The delivery section 5 may have sufficient length to facilitate grasping the loading device 10 along the delivery section 5 of the tubular delivery body 14.

Referring now to FIG. 6, the flow of gunpowder from the charge receiving body 12 through the tubular delivery body 14 is further facilitated by the angle $\alpha$ of the inner, frustoconical surfaces 132 of the transition section 9 of the tubular delivery body 14 and the inner diameter 36 of the delivery section 5.

The inner diameter 36 of the delivery section 5 may be selected on the principle that a minimum internal diameter 36 of the delivery section 5 should be at least 3.5 times the size of the largest powder charge particle to prevent bridging of the gun powder when it flows out of the loading device. This aspect becomes even more important for the smaller calibers of muzzleloaders.

The angle $\alpha$ of the inner frustoconical surfaces 132 of the transition section 9 may be selected such that the free flow of gunpowder from the charge receiving body 12 through the tubular delivery body 14 is assured and bridging is eliminated, even when the loading device 10 is held off a true vertical orientation during pouring of the gunpowder. In this regard, the tubular delivery body 14 may perform satisfactorily when the angle $\alpha$ is set in the range of about 40° to about 50°, more preferably in the range of about 43° to about 47°, and most preferably about 45°.

In some embodiments, the delivery section 5 and the connector section 7 of the tubular delivery body 14 may be cylindrical and concentric of one another and the wall thickness of the delivery section 5 may be less than that of the transition section 9 and the connector section 7.

Once the gunpowder 18 has been poured from the receiving body 12 through the delivery body 14 into the muzzle, the user may then detach the projectile chamber body 22 from the closed end 37 of the receiving body 12 and remove the projectile 23 (together with any patch, wadding or sabot) therefrom and seat the projectile 23 (by hand) at the muzzle of the firearm. Thereupon, the delivery end 11 of the delivery body 14 may be positioned atop the seated projectile 23 and the loading device 10 pushed downwardly until the muzzle comes into contact with the outer portions of the transition section 9 of the delivery body 14, which at this stage of the loading procedure, serves as a stop. In such manner, the delivery body 14 may serve as a short starter. The projectile may then be pushed further down the barrel with a ram rod until seated against the already poured charge of gunpowder.

Lastly, the primer 25 may be removed from the nipple 24 of the projectile body 22 and transferred to the appropriate primer nipple (receptacle) of the firearm.

Referring now to FIG. 8A, when one or more shaped pellets of gunpowder 45 are used instead of granular gun powder 18, the above described loading sequence is much the same except for how the gunpowder is delivered to the muzzle. In this embodiment, the user holds the loading device 10 in an upright orientation such that the cap 21 is atop the loading assembly 10 (in an orientation opposite of that shown in FIG. 8A), whereupon the user removes the entire delivery body 14 from the charge receiving body 12 such that upon tilting of the receiving body 12, the shaped pellets 45 transfer directly from the receiving body 12 to the muzzle of the firearm or to the hand of the user for manual placement of the pellet(s) into the muzzle. In this embodiment, the interior surfaces 132 of the transition section 9 of the delivery body 14 may serve as a stop to limit longitudinal movement of the shaped pellets 45 while being stowed in the loading device 10 before use.

Figure 9:
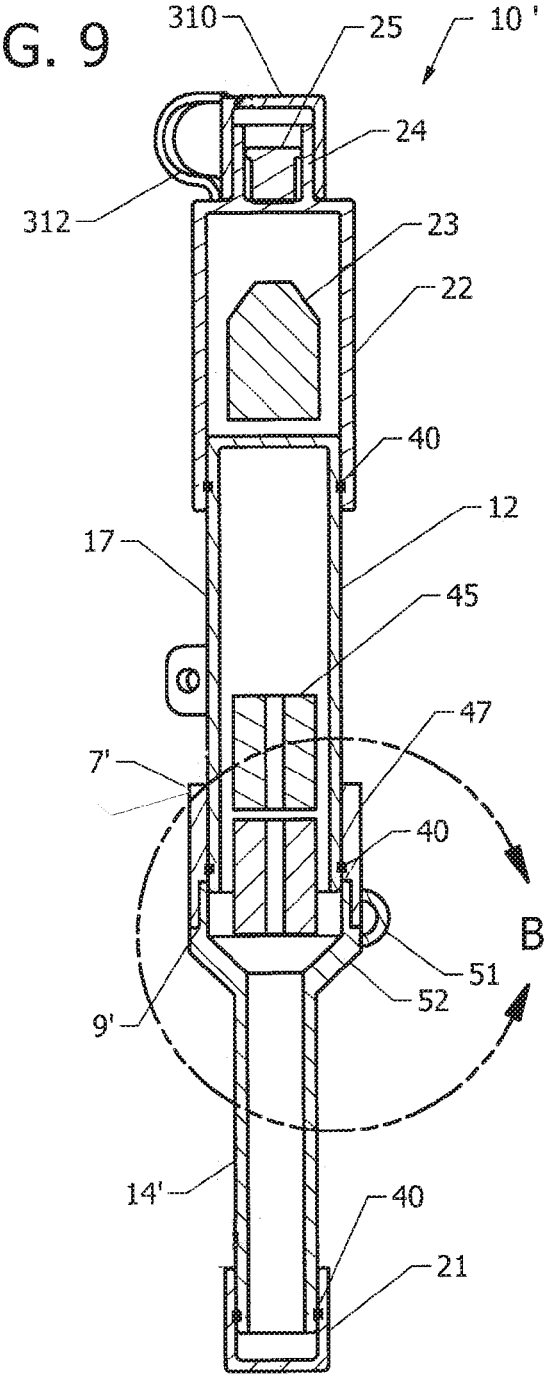
FIG. 9 is a cross-sectional side view of a loading device in a loaded and assembled condition, constructed in accordance with another embodiment of the present disclosure.
Figure 10:
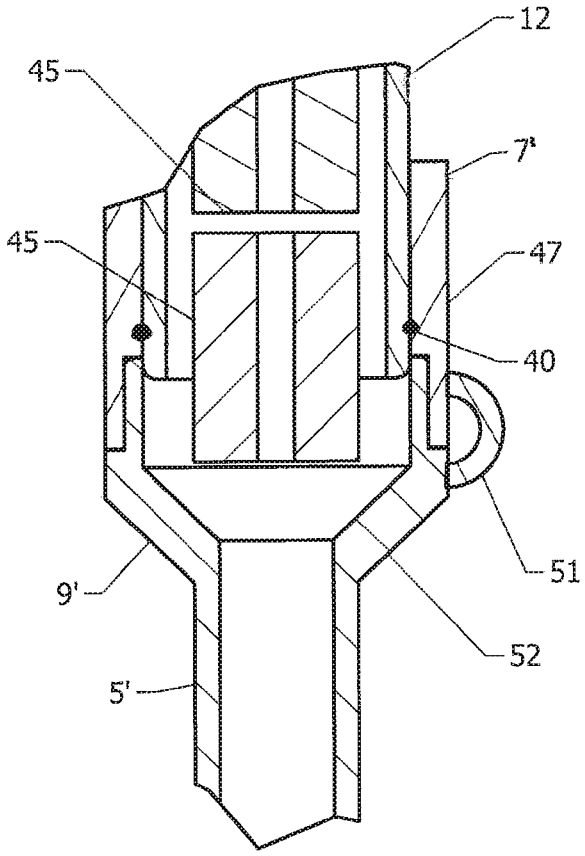
FIG. 10 is a detail view of the area enclosed by the double arrow B in FIG. 9.

Referring now to FIG. 9, in an embodiment, the delivery body 14' is articulated such that the delivery end section 5' and the frustoconical transition section 9', together with the cap 21, is disengageable as a flip-away unit 52 from the connector end section 7'. In some embodiments, a flexible connector 51 between the flip-away unit 52 and the connector end section 7' assures retention of the flip-away unit 52 with the remainder of the loading device 10 during and after use. This arrangement facilitates removal of shaped pellets of gunpowder 45 from the load device 10', yet is operable as previously described when granular gunpowder 18 is stowed and poured.

Referring now to FIGS. 8A and 8B, the loading device 10 may be provided with a number of seals 40 operative between elements that are slidingly engaged with one another. Each seal may comprise a groove 42 which acts as a retaining seat for a resilient ring (o-ring) 41. In some embodiments, seals 40 may be placed about the closed end portion 37 of the tubular receiving body 12 to enhance sealing between that and the projectile receiving body 22. A seal 40 may also be placed adjacent the open end 13 of the receiving body 12 to enhance sealing between the latter and the tubular delivery body 14. Likewise, a seal 40 may be provided adjacent the delivery end 11 of the tubular delivery body 14 so as to enhance sealing between the cap 21 and the tubular delivery body 14.

The teachings herein may be practiced with variations of what is specifically shown and described herein. For example, the connector 20 may extend from the cap 21 to other components of the loading device 10 instead of extending to the tubular delivery body 14 as specifically shown and described, such as to the charge receiving body 12 or to the projectile receiving body 22. Likewise, the connector 312 may extend from the second cap 310 to other components of the loading device 10 instead of extending to the projectile receiving body 22 as specifically shown and described, such as the charge receiving body 12 or the tubular delivery body 14. A lanyard receiver 16 may be disposed upon various components of the loading device 10, other than just the charge receiving body 12 as specifically described. Furthermore, the various components of the loading device 10 are shown and described as being generally tubular (cylindrical). Instead, they may be constructed to have a different cross-section such as polygonal cross-section (octagon or square cross-section or the like) or with an oval cross-section, or others. Similarly, fittings between the components of the loading device 10 may be other than sliding fits such as specifically described, and may include other fittings such as a threaded fit or keyed fit or the like. It is also contemplated that the lanyard 211 may be attached to the loading device 10 using a receiver configured differently than the tab 16 as specifically disclosed, such as a suitable catch, a flexible hook or other suitable convenience for receiving a portion of the lanyard 211.

Clearly, minor changes may be made in the form and construction of this invention without departing from the material spirit thereof. It is not, however, desired to confine the invention to the exact form herein shown and described, but it is desired to include all such as properly come within the scope claimed.

While the present disclosure has been described and illustrated by reference to particular embodiments, those of ordinary skill in the art will appreciate that the disclosure lends itself to variations not necessarily illustrated herein. For this reason, then, reference should be made solely to the appended claims for purposes of determining the true scope of the present invention.

We claim:

1. A system for containing and loading a charge into a muzzleloader, comprising:

a first tubular receiving body having a closed end, an open end and a space enclosed by the first tubular body of sufficient volume to fully receive a charge;

a second tubular delivery body comprising:

an open ended connector section connectable with the open end of the first tubular receiving body;

a delivery section receivable within a bore of a muzzleloader, an inner diameter of the delivery section being less than an inner diameter of the open ended connector section;

a frustoconical transition section communicating the open ended connector section with the delivery section;

a removable closure operable to close a delivery end of the delivery section;

wherein the first tubular receiving body is configured when uncoupled from the second tubular delivery body to receive a premeasured charge in the first tubular receiving body, whereupon the first tubular receiving body and the second tubular delivery body are configured when coupled and the removable closure closed to protectively retain the premeasured charge until use, whereupon when the closure is opened the delivery section is configured to facilitate pouring of the charge while tilting the system and at least partially inserting the delivery end of the delivery section into the bore of the muzzleloader.

2. The system of claim 1, wherein the frustoconical transition section converges at an angle in the range of about 43 to about 47 degrees and the inner diameter of the delivery section is sufficiently greater than a largest nominal dimension of granules comprising the charge, whereby bridging of granules across the delivery section is alleviated.

3. A load carrier for a muzzleloader having a muzzle, comprising:

a first assembly component comprising: a tubular open-ended charge receiving body configured to receive a charge though an open end section of the tubular open-ended charge receiving body; and a second assembly component engageable with the first assembly component, comprising: a tubular delivery body comprising a delivery end section and a connector end section, the delivery end section having an external diameter so as to be insertable into the muzzle; and a removeable cap engageable with the delivery end section;

the connector end section engageable with the open end section of the charge receiving body of the first assembly component;

the charge receiving body of the first assembly component configured to directly receive a charge of gunpowder when the second assembly component is disengaged from the first assembly component;

whereby engagement of the first assembly component with the second assembly component and engagement of the cap is configured to contain the received charge until use;

whereby the second assembly component and the first assembly component when engaged are configured to pour the contained charge into the muzzle upon disengagement of the cap;

at least a portion of the delivery end section insertable into the muzzle during pouring to facilitate consistent and speedy loading.

4. The load carrier of claim 3, wherein the first assembly component further comprises:

a tubular projectile receiving body configured to receive a projectile though an open end section of the projectile receiving body;

the open-end section of the projectile receiving body engageable with a closed end section of the charge receiving body, whereby the projectile receiving body is closable with such engagement and openable with disengagement of the open end section of the projectile receiving body from the closed end section of the charge receiving body;

whereby a projectile may be contained within the first assembly component until use.

5. The load carrier of claim 4, wherein the first assembly component further comprises a flexible connector between the projectile receiving body and the charge receiving body and/or the second assembly component further comprises a flexible connector between the cap and the tubular delivery body.

6. The load carrier of claim 5, wherein the first body and/or the second body is a unitary, molded piece.

7. The load carrier of claim 4, wherein the projectile receiving body of the first assembly component further comprises a nipple of a size sufficient to receive a primer.

8. The load carrier of claim 3, wherein the connector end section of the tubular delivery body engages about an outer surface of the open end section of the charge receiving body, the connector end section having an inner diameter greater than an inner diameter of the delivery end section, the tubular delivery body further comprising a frustoconical transition section between the delivery end section and the connector end section.

9. The load carrier of claim 8, wherein the delivery end section has an inner diameter greater than about three times a largest nominal dimension of granules comprising the charge, whereby bridging of the granules across the delivery end section is avoided.

10. The load carrier of claim 9, wherein the delivery end section has a length sufficient to abate spilling of a portion of the charge while moving of the load carrier from an upright position into a tilted, pouring position.

11. The load carrier of claim 9, wherein the delivery end section is provided a length sufficient to by-pass a muzzle brake port adjacent the muzzle.

12. The load carrier of claim 9, wherein the delivery end section has a length and configuration to be operative as a short starter.

13. The load carrier of claim 4, further comprising a seal operative between:

the cap and the delivery end section of the tubular delivery body; and/or the open end section of the charge receiving body and the connector end section of the tubular delivery body; and/or the closed end section of the charge receiving body and the open end section of the projectile receiving body.

14. The load carrier of claim 9, wherein the outer diameter of the delivery end section of the tubular delivery body is less than the caliber of the muzzle and an outer diameter of the connector end section of the tubular delivery body is greater than the caliber of the muzzle, whereby the transition section is operative as a stop against further insertion of the tubular delivery body into the muzzle.

15. The load carrier of claim 4, wherein:

the cap is cup shaped and engages the delivery end section of the tubular delivery body with a first sliding fit; and the connector end section engages about the outer surface of the open end section of charge receiving body with a second sliding fit;

the second sliding fit being more resistive to opening than the first sliding fit, whereby the cap may be removed without disengaging the second assembly component from the first assembly component.

16. The load carrier of claim 3, further comprising a lanyard and a receiver for attachment of the lanyard to the load carrier.

17. The load carrier of claim 9, wherein the tubular delivery body is articulated such that the delivery end section and the frustoconical transition section are disengageable as a flip-away unit from the connector end section of the tubular delivery body;

the load carrier further comprising a flexible connector between the flip-away unit and the connector end section of the tubular delivery body.

18. The load carrier of claim 7, further comprising a second cap removably engageable with the nipple, when engaged with the nipple, the second cap being operative to protect content of the nipple from a surrounding environment.

19. The load carrier of claim 18, further comprising a flexible connector operative between the second cap and the projectile receiving body, and wherein the nipple is of a sufficient size to receive any one of a variety of differing standard sized primers.

20. A tubular delivery body operable with an open ended, tubular load carrier for a muzzleloader, the tubular delivery body comprising:

a delivery end section having an external diameter so as to be insertable into a muzzle of a muzzleloader;

an open ended connector section having a diameter so as to be slidingly joinable with an open end of a tubular load carrier, the diameter of the open ended connector section greater than the external diameter of the delivery end section;

a frustoconical transition section communicating the connector section with the delivery section; and a removable cap operable to close a delivery end of the delivery end section;

whereby the tubular delivery body is disengageable from the load carrier so that a charge of gunpowder may be directly received by the load carrier;

whereby the connector section of the tubular delivery body is configured to engage the load carrier and the removable cap configured to close the delivery end such that the received charge may be contained until use;

the tubular delivery body configured to pour the contained charge into the muzzle upon disengagement of the cap while maintaining engagement of the tubular delivery body with the load carrier;

at least a portion of the delivery end section insertable into the muzzle during pouring to facilitate consistent and speedy loading.

* * * * *